United States Patent [19]

Szabo

[11] Patent Number: 4,614,032

[45] Date of Patent: Sep. 30, 1986

[54] HAIR-CUTTING APPARATUS AND RAZOR

[76] Inventor: Stephan L. Szabo, Peteracherstrasse 2, CH-8126 Zumikon, Switzerland

[21] Appl. No.: 598,147

[22] PCT Filed: Jun. 27, 1983

[86] PCT No.: PCT/CH83/00082

§ 371 Date: Mar. 8, 1984

§ 102(e) Date: Mar. 8, 1984

[87] PCT Pub. No.: WO84/00319

PCT Pub. Date: Feb. 2, 1984

[30] Foreign Application Priority Data

Jul. 15, 1982 [CH] Switzerland ..... 4298/82

[51] Int. Cl.[4] ..... B26B 21/12

[52] U.S. Cl. ..... 30/31; 30/122; 30/123

[58] Field of Search ..... 30/30, 31, 34 R, 34.1, 30/86, 87, 89, 90, 122, 123, 152; 132/80 R, 45 R, 45 A

[56] References Cited

U.S. PATENT DOCUMENTS

| | | | |
|---|---|---|---|
| 237,138 | 2/1881 | Slayton | 30/152 |
| 1,765,256 | 6/1930 | Barnes | 30/53 X |
| 2,488,436 | 11/1949 | Santoro | 30/34 R |
| 3,408,737 | 11/1968 | Steere et al. | 30/90 |
| 4,011,656 | 3/1977 | Liedtue | 30/30 |

*Primary Examiner*—Douglas D. Watts

*Attorney, Agent, or Firm*—Flynn, Thiel, Boutell & Tanis

[57] ABSTRACT

The hair-cutting appliance comprises a blade held interchangeably in a two-piece housing and located between a stationary row of teeth at the edge of the lower part of the housing and a row of teeth adapted to be moved back and forth in relation to the blade. A retaining arm, with a razor-blade head secured interchangeably thereto, is mounted pivotably at the edge of the housing remote from the blade and the razor-blade head is adapted to pivot outwardly from a nonoperative position within the housing, through an aperture in the lower part thereof, into an operative position. When the razor-blade head is in use, the housing of the hair-cutting appliance serves as a handle. The hair-cutting appliance therefore performs a dual function, since it may be used not only for cutting hair, but also for shaving.

7 Claims, 11 Drawing Figures

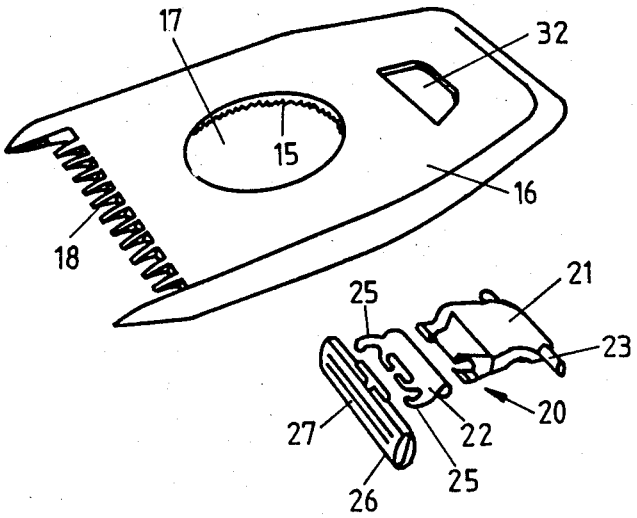
FIG. 1
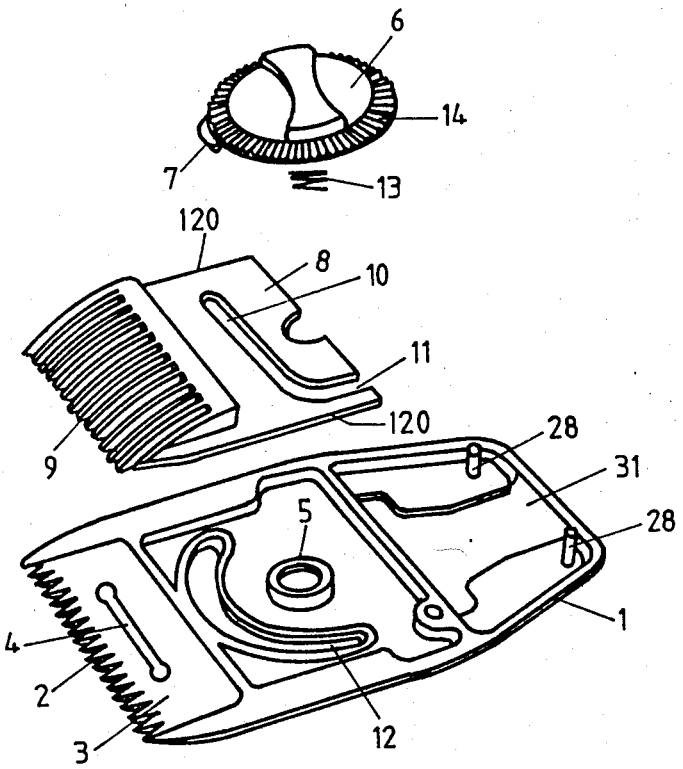

FIG. 10
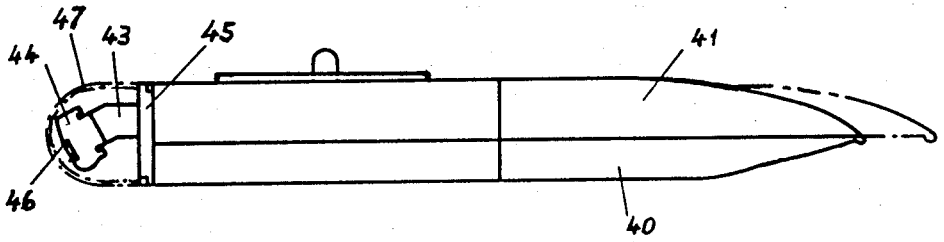
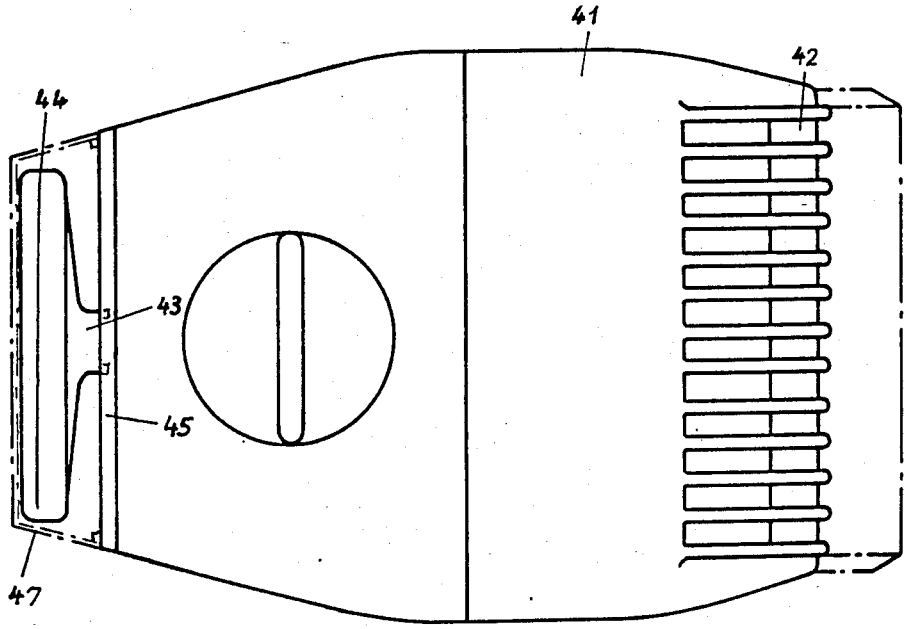
FIG. 11

HAIR-CUTTING APPARATUS AND RAZOR

FIELD OF THE INVENTION

The invention relates to a hair-cutting appliance comprising a blade held interchangeably in a housing, the cutting edge of which projects beyond one edge of the housing, and has a comb-like row of teeth which bear against the blade and project beyond the cutting edge thereof, the row of teeth being adapted to be locked in varius positions in relation to the blade for the purpose of varying the distance between the tips of the teeth and the cutting edge in order to alter the length of the cut.

BACKGROUND OF THE INVENTION

Various designs of such hair-cutting appliances are known, in which the combination of a blade intended for cutting and a row of teeth makes it possible, by guiding the applicance through the hair, for the hair to be lined up by the row of teeth in the working direction of the appliance, in the spaces between the teeth, and to be cut by the cutting edge of the blade which is exposed in the spaces. Since the teeth may be set to project selectively by various amounts beyond the cutting edge of the blade, it is possible to operate with the cutting edge at various distances from the scalp. This provides different lengths of cut, from thinning of the hair to shaving the neck. In one known appliance, the different distances between the tips of the teeth and the cutting edge of the blade are obtained by changing over a part of the housing, the opposing edges of which comprise rows of teeth of different lengths, the housing-part being assembled to a similar second housing-part, and the blade being secured between the two parts. In another known appliance of this kind, a part comprising a row of teeth is pushed back and forth in relation to the blade.

SUMMARY OF THE INVENTION

It is the purpose of the present invention to expand the functions of an applicance of the known type in such a manner that it may be used for shaving in addition to its normal function of cutting hair. This makes the appliance more versatile, since it also constitutes a housing or case for the protective accommodation of the part intended for shaving. This makes it unnecessary to provide a separate case affording protection against injury from the very sharp razor blade.

In the hair-cutting appliance of the type mentioned above, this purpose is achieved in that a razor-blade head secured to a retaining arm is arranged at the edge of the housing remote from the blade. The retaining arm carrying the razor-blade head is preferably mounted pivotably in the housing, the housing being provided with an aperture through which the retaining arm, with the razor-blade head, is adapted to pivot from a non-operative position, in which the retaining arm and razor-blade head are located within the housing, to an operative position in which the retaining arm and razor-blade head project obliquely from the housing in a stopped position, the housing serving as a handle when it is desired to use the razor-blade head.

BRIEF DESCRIPTION OF THE DRAWINGS

Further details and advantages of the invention may be gathered from the following description and from the drawings attached hereto illustrating, purely by way of example, an example of an embodiment of the invention. In the drawings:

FIG. 1 is a perspective representation of all of the parts of the appliances arranged in the sequence in which they are assembled;

FIGS. 10 and 11 are a side elevation and a plan view respectively of a modified example of embodiment of the hair-cutting appliance.

DETAILED DESCRIPTION

Figure 2:
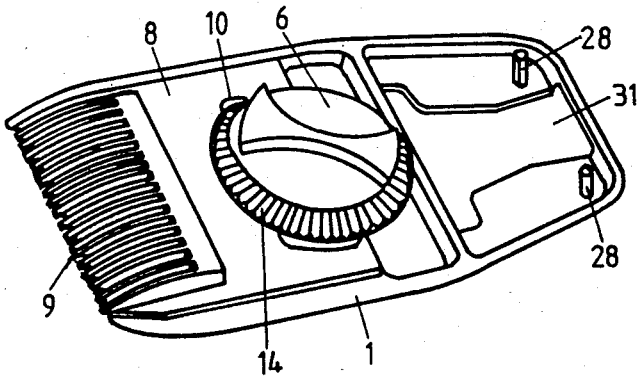
FIG. 2 shows all of the parts of the applicance assembled with the exception of the upper part of the housing, the part carrying the row of teeth being in the retracted position.

The hair-cutting appliance comprises, according to FIG. 1 in the form of a recess, a lower housing-part 1 comprising, at its edge, a stationary row of teeth 2 a slightly depressed area 3 is provided adjacent the row of teeth 2 and serves to accommodate a blade therein, not shown in the drawing. A small projection 4 is provided within area 3 and serves to locate a blade cut to fit this projection. Located at the centre of the dish-shaped housing-part 1, made in one piece out of plastic, is an annular bearing 5 serving to accommodate a pivot pin, not shown in the drawing, located on the under-side of a rotating knob 6. This rotating knob carries, on its under-side, a pin 7 eccentrically arranged of its axis of rotation. Resting upon the lower housing-part 1 is a plate 8 carrying a row of teeth 9 at one edge. The plate 8 comprises an elongated slot 10, extending at right angles to the direction of movement thereof, in which the pin 7, on the under-side of the rotating knob 6 of the eccentric, is received. Adjoining the transverse slot 10 is a slot 11 extending in the direction of movement of the plate 8, to the rear edge thereof, where the slot is left open, thus allowing the pin 7 to leave the slot in order to separate the plate completely from the rotating knob 6.

Figure 3:
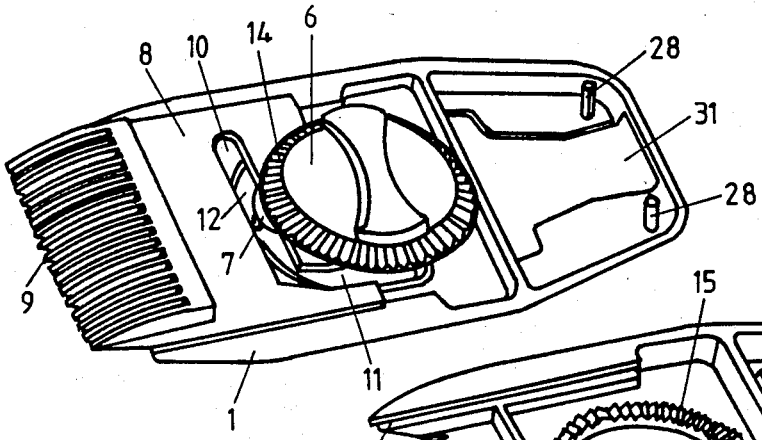
FIG. 3 is a view of the appliance as in FIG. 2, but with the part carrying the row of teeth extended.

The pin 7 on the under-side of the rotating knob 6 is also received in an arcuate channel 12 formed in the lower housing-part 1 and limits the extent of rotation of the knob 6 when the pin comes to a stop at one end or the other of the channel 12. When the pin 7 is located centrally of the transverse slot 10 in the plate 8, the latter is in its outermost position in relation to the housing-part 1 and the distance between the tips of the teeth in row 9 and the cutting edge of the blade, not shown in the drawing, is at its maximum. When the knob 6 is rotated and pin 7 moves to the left or right in the slot 10, the plate 8 is moved rearwardly. FIG. 2 shows the plate 8 fully retracted, while FIG. 3 shows the plate fully extended.

Figure 7:
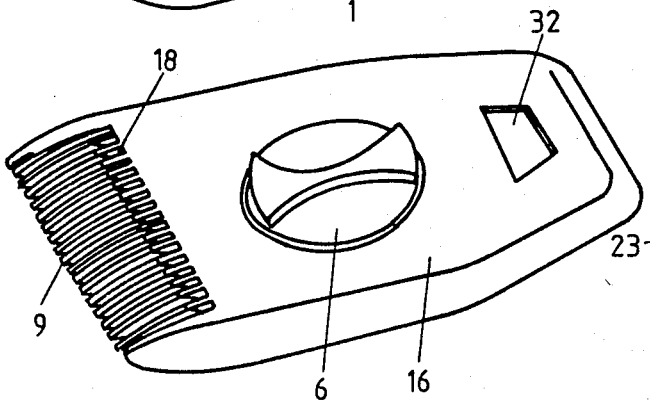
FIG. 7 shows the complete appliance as viewed toward the direction of the upper part of the housing.

Inserted into the annular bearing 5 is a compression-spring 13 (FIG. 1) shown below the knob 6, the toothed flanged edge 14 of the knob being pressed thereby against a toothed annular part 15 (FIGS. 4 and 5) on the inside of an upper housing-part 16. This allows the knob 6 to be indexed in any desired position of rotation, so that the plate 8, with row of teeth 9, is secured with one edge in the desired position. The upper housing-part 16 is of the same size as the lower housing-part 1, being attached thereto preferably by gluing, or in some other suitable manner. The upper housing part 16 comprises an aperture 17 through which the knob 6 passes so that it can be actuated. The upper housing-part also comprises, at one edge, a stationary row of teeth 18 with short teeth which bear upon the teeth in the row of teeth 9 on the plate 8, as shown in FIG. 7.

The row of teeth 18 at the edge of the upper part of the housing, also made in one piece out of plastic, is provided for aesthetic reasons so that the teeth accurately concede with the teeth in rows 9 and which extend to and merge into the upper side of the housing. Cut hair is thus carried away satisfactorily and cannot lodge at the edge of the upper part of the housing.

Figure 4:
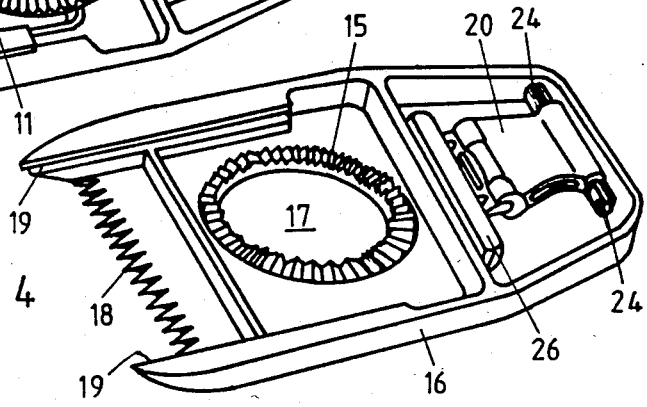
FIG. 4 shows the inside of the upper part of of the housing, with the attached retaining arm and the razor-blade head pivoted inwardly.
Figure 5:
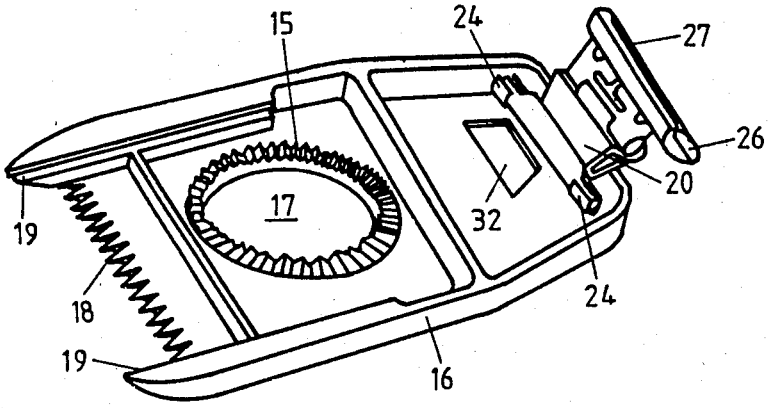
FIG. 5 shows the upper part of the housing according to FIG. 4, with the retaining arm and razor-blade head pivoted outwardly.

As may be gathered from FIGS. 4 and 5, the opposite edges of the inside of the upper housing-part 16 are stepped, thus providing guide-surfaces 19 for corresponding edges 120 (FIG. 1) of the plate 8 as the latter moves back and forth. Also visible in FIGS. 4 and 5 is the annular toothed part 15 enclosing the aperture 17 in the upper housing-part 16, the part 15 being adapted to engage with the toothed flanged edge 14 of the rotating knob 6.

According to FIGS. 4 and 5, a retaining arm 20, also shown in FIG. 1 in separate pieces below the upper housing part 15, is pivotably mounted inside the upper housing-part at the edge remote from the row of teeth 18. The arm 20 consists of parts 21,22 which are adapted to be united, part 21 also carrying a pivot axle 23 mounted pivotably in two bearing elements 24 inside the upper housing-part 16. The part 22 of the plastic retaining arm 20 comprises two resilient fingers 25 which are adapted to engage and become coupled to the back of a conventional razor-blade head 26 and thus secure it. The head is pivotable to some extent.

Figure 8:
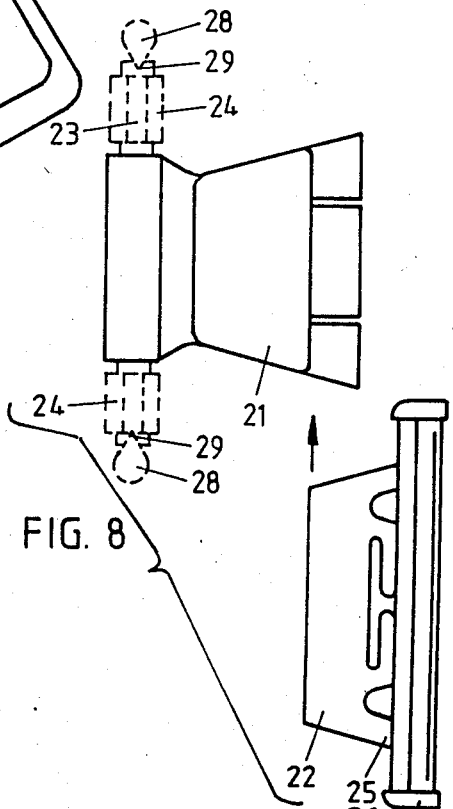
FIG. 8 is a plan view, in an enlarged scale, of the retaining arm and the razor-blade head separate from each other.
Figure 9:
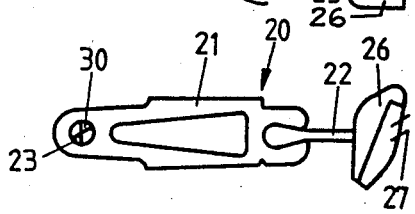
FIG. 9 is a side elevation of the retaining arm and razor-blade head, to the scale according to FIG. 8.

The resilient fingers 25 of the part 22 make it a simple matter to replace the razor-blade head 26 which is a conventional head comprising a tandem-blade 27. Details of the retaining arm 20, with razor-blade head 26 arranged at the end thereof, are shown more clearly, and to an enlarged scale, in FIGS. 8 and 9. It may also be seen from these figures that two pins 28, secured to the inside of the lower housing part 1 as shown in FIGS. 1 to 3, have knife-edges 29 co-operating with an axle 23 mounted pivotably in the upper housing-part 16. According to FIG. 9, the axle 23 comprises an intersecting incision 30 in each end-face with which the knife-edges 29 may engage to form a detent mechanism. As a result of this, the retaining arm 20 is locked in two different pivoting positions.

Figure 6:
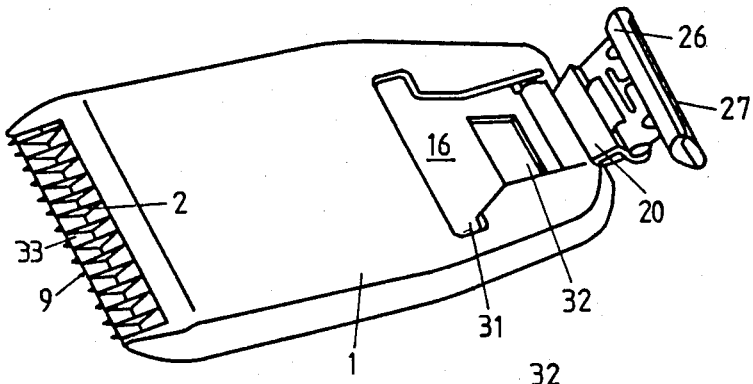
FIG. 6 shows the complete appliance as viewed toward the direction of the lower part of the housing, with the retaining arm and razor-blade head pivoted outwardly.

For the purpose of pivoting the retaining arm 20, with razor-blade head 26 arranged at the end thereof, out of the housing, consisting of the lower housing-part 1 and the upper housing-part 16, and in which the arm is accommodated in the non-operative position, into the operative position shown in FIGS. 5 and 6, the lower housing part 1 is provided with a suitably shaped aperture 31 through which the retaining arm and razor-blade head may be pivoted outwardly. The upper housing-part 16 has an additional aperture 32 through which the retaining arm 20 may be pushed out with a finger. FIG. 6 shows the back of the appliance with the retaining arm 20, carrying the razor-blade head 26, pivoted outwardly into the operative position. Also visible in FIG. 6 is a hair-cutting blade 33 secured to the lower housing-part 1 and projecting slightly beyond the row of teeth 2 at the edge of the said lower housing-part. FIG. 7 shows the front of the appliance.

A modified design of the hair-cutting appliance is illustrated in FIGS. 10 and 11, which also consists of a lower housing-part 40 and an upper housing part 41, a razor-blade haed 44 secured to a retaining arm 43, arranged at the edge of the housing remote from the blade 42. In this case, the retaining arm 43 is fitted replaceably to a rail 45 at the edge of the housing 40,41 for the purpose of replacing the retaining arm 43 and the razor-blade head 44 when blades 46 therein are no longer sharp. The conventional razor-blade head 44 is preferably equipped with a tandem-blade.

When the rator-blade head 44 is not in use, it is covered by a protective cap 47 shown in dotted outline. The appliance intended for cutting hair may thus be used for shaving after the protective cap 47 has been removed, the housing of the hair-cutting appliance being used as a handle.

The embodiments of the invention in which an exclusive property or privilege is claimed are defined as follows:

1. In a hair-cutting appliance, comprising: a housing, a blade held interchangeably in said housing, a cutting edge of said blade projecting beyond an edge of said housing, and a comb-like row of teeth bearing against said blade and projecting beyond said cutting edge thereof, means for varying the distance between the tips of said teeth and said cutting edge to effect an altering of the length of hair to be cut, and locking means for locking said tips of said teeth in various positions in relation to said blade, the improvement comprising wherein a retaining arm is secured to said housing at a location remote from said blade, said retaining arm having coupling means thereon adapted to be coupled to a razor-blade head, and enclosure means for housing said retaining arm and shielding said razor-blade head, if it is coupled to said razor-blade head, when said razor-blade head is not in use, wherein pivot means are provided for pivotally mounting said retaining arm to said housing, said enclosure means comprising an aperture in said housing through which said retaining arm is adapted to pivot from an inoperative position, in which said retaining arm is located within said housing, into an operative position, in which said retaining arm projects obliquely from said housing, said housing serving as a handle when said retaining arm is in said operative position, and wherein said housing consists of a lower part and an upper part, said aperture being provided in said lower part and a smaller aperture in said upper part adapted to receive a users finger therein for effecting a pushing of said retaining arm out of said aperture by said finger.

2. The appliance according to claim 1, wherein said coupling means includes means enabling an interchangeable coupling of said razor-blade head to said retaining arm.

3. The appliance according to claim 1, wherein said razor-blade head consists of a plastic element having at least one blade secured permanently therein.

4. The appliance according to claim 1, wherein said housing includes guide means and a plate having a comb-like row of teeth on one edge thereof, said plate being slidably mounted on said housing for movement in said guide means back and forth between said lower part and said upper part, a rotatable actuating knob operatively connected to said plate for effecting said movement of said plate in response to a rotation of said knob, said knob being rotatably mounted on said lower part of said housing and extends through a circular aperture in said upper part thereof, said rotatable knob having a pin arranged eccentrically of the axis of rotation of said knob, said pin being slidingly received in a slot arranged in said plate and extending at right angles to the direction of movement thereof, said pin moving said plate back and fourth when said knob is rotated.

5. The appliance according to claim 4, wherein a further slot extends in the direction of movement of said plate, adjoins said slot extending at a right angle to said direction of movement, said further slot thereby making it possible to remove said plate from said housing in order to facilitate a change of the blade.

6. The appliance according to claim 4, wherein said rotatable knob has a flanged peripheral edge, the upper surface of which is toothed and is pressed, by a compression spring arranged below said knob, against a toothed annular part on an inside portion of said upper part of said housing, for the purpose of securing said plate in the desired position by an engagement of said teeth with each other.

7. The appliance according to claim 1, wherein said enclosure means comprises a removable protective cap.

* * * * *